United States Patent [19]

Fredericksen et al.

[11] Patent Number: 4,878,463

[45] Date of Patent: Nov. 7, 1989

[54] NEEDLE BEARING ROCKER ARM ASSEMBLY

[75] Inventors: Arnold E. Fredericksen, New Hartfort; Robert D. Richtmeyer, Goshen, both of Conn.

[73] Assignee: The Torrington Company, Torrington, Conn.

[21] Appl. No.: 103,988

[22] Filed: Oct. 1, 1987

[51] Int. Cl.[4] ..... F01L 1/18

[52] U.S. Cl. ..... 123/90.41; 74/559

[58] Field of Search ..... 123/90.39, 90.41, 90.44; 74/559, 519; 384/2, 154

[56] References Cited

U.S. PATENT DOCUMENTS

| | | | |
|---|---|---|---|
| 3,418,985 | 12/1968 | Hirose | 74/519 |
| 3,621,823 | 11/1971 | Lombardi | 74/519 |
| 4,497,307 | 2/1985 | Paar et al. | 123/90.41 |
| 4,628,874 | 12/1986 | Barlow | 123/90.39 |
| 4,718,379 | 1/1988 | Clark | 123/90.39 |

*Primary Examiner*—Willis R. Wolfe
*Assistant Examiner*—M. Macy
*Attorney, Agent, or Firm*—Frank S. Troidl

[57] ABSTRACT

A rocker arm assembly for a fixed rocker shaft has an open rocker arm body containing a bearing supported radially by the rocker arm side walls axially position the bearing.

6 Claims, 1 Drawing Sheet

0252 — TC — BE
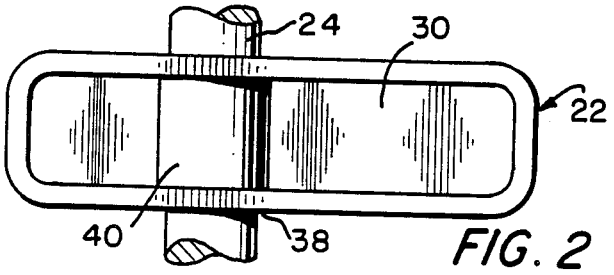
FIG. 2
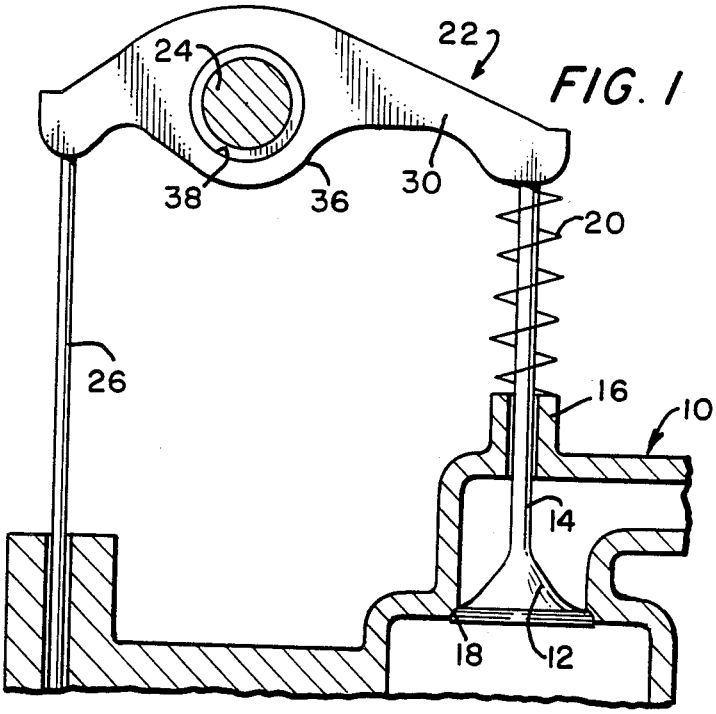
FIG. 1
FIG. 3
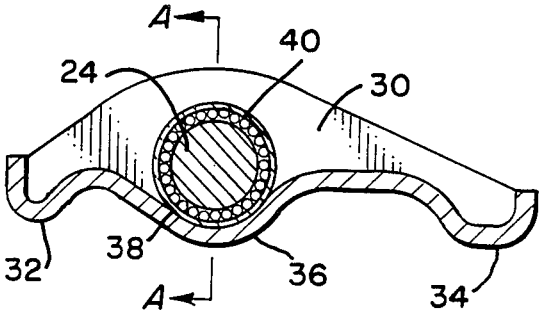
FIG. 4
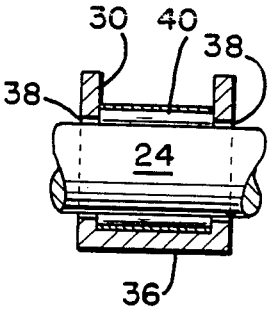

NEEDLE BEARING ROCKER ARM ASSEMBLY

BACKGROUND OF THE INVENTION

This invention relates to rocker arm assemblies having a fixed rocker shaft used in valve train mechanisms of internal combustion engines and in particular to a rocker arm assembly used in cam in head or cam in block type internal combustion engines.

One type of valve train, as used in internal combustion engines, has the rocker arm pivotally journaled on a fixed rocker shaft. Often the journal is merely the bore in the rocker arm supporting the shaft. As the rocker arm oscillates back and forth, the friction between the arm and shaft is transmitted to the valve train assembly. Also, since the rocker arm only oscillates about the journal, the loading is substantially applied in one concentrated area of the journal.

SUMMARY OF THE INVENTION

It is therefore a primary object of the present invention to provide a new rocker arm assembly incorporating an anti-friction bearing that will reduce the overall friction in the valve train.

It is another object of this invention to provide a rocker arm assembly that is easily manufactured and assembled.

It is another object of this invention to provide an improved rocker arm assembly having a bearing on which the loading is distributed.

Thus, the new rocker arm assembly of the present invention will reduce the friction of the valve train, increase the performance of the engine, increase reliability and life expectancy of the rocker arm, lower manufacturing and assembly costs, and allow easy installation. These and other features and advantages of the invention will be more fully understood from the following description of the preferred embodiment, taken together with the accompanying drawings.

BRIEF DESCRIPTION OF THE DRAWINGS

FIG. 1 is a partial cross sectional view of the portion of an internal combustion engine illustrating a portion of the valve train of the engine including a rocker arm assembly.

FIG. 2 is a top view of a rocker arm assembly mounted on a rocker shaft.

FIG. 3 is a cross section of the rocker arm assembly.

FIG. 4 is a cross sectional view of the rocker arm according to Section AA of FIG. 2.

DETAILED DESCRIPTION OF THE PREFERRED EMBODIMENT

Referring now to FIG. 1 of the drawings there is illustrated a portion of an engine which includes a cylinder head 10 which is fixed to an engine block in a conventional manner. A poppet valve 12 having a stem 14 is reciprocally supported in a valve guide 16 in the cylinder head for movement to open and close a port 18, which can either be an inlet or exhaust port. The poppet valve is normally biased to its closed position, as shown, by a valve return spring 20. The valve stem is in contact with one end of a rocker arm assembly 22.

A cam shaft (not shown) actuates a push rod 26 which is in contact with the other end of the rocker arm assembly. The rocker arm assembly 22 is pivotally mounted on a rocker shaft 24. The poppet valve 12 is actuated by the push rod 26 via the rocker arm assembly. Each rocker arm assembly thus has one end operated on by a push rod while its opposite end contacts the end of the valve stem for actuating the valve in a manner well known in the internal combustion art. The rocker shaft 24 is supported in the engine in a conventional manner.

The rocker arm assembly 22, as best seen in FIGS. 2, 3, and 4, will now be described. The rocker arm body 30 is provided with two arms 32 and 34 overlying the upper ends of the push rod 26 and the valve stem 14 as was previously described. The rocker arm body is also provided with a central pivot portion 36 having transverse shaft receiving bores 38 extending there through.

As best seen in FIG. 2, the rocker arm body has side walls, end walls and a bottom wall and resembles a tub because of its shape and open top. A central pivot portion 36 is formed by a semi-cylindrical protrusion of the bottom surface of the rocker arm body. The semi-cylindrical surface has an inner diameter equal to the outer diameter of a bearing 40 so that the pivot portion provides radial support for the bearing.

The pivot portion has transverse coaxial bores 38, through each sidewall, as shown in the section of FIG. 4. The bores 38 have a diameter large enough to allow the insertion of the rocker shaft 24, but small enough to provide axial positioning of the bearing 40 within the rocker arm. The bearing 40 is dropped into position in the pivot portion through the open top of the rocker arm body. No additional bearing housing is required.

The bores 38 do not have to be round. The bores may be any shape that has reduced diameter portions to retain the bearing axially within the rocker arm body.

The bearing member 40 of the rocker arm assembly is sized to fit in the central pivot portion 36. The bearing has an inner diameter that is adapted to fit the rocker shaft 24. The outer diameter surface of the bearing 40 is in contact with the bottom surface of the central pivot portion.

Bearings that can be used in the present invention are any standard manufactured caged or full complement needle bearing with an outer race or a cage and roller assembly. In all cases, the shaft serves the inner race contact surface for the needles or rollers With the cage needle bearing and cage and roller assembly the pivot portion bottom surface could serve as the outer race.

The rocker arm body is constructed so that it could be manufactured by stamping a sheet metal piece to the proper configuration.

In operation as the rocker arm 30 is caused to oscillate, the bearing generally oscillates with the pivot portion. The bearing greatly reduces the friction between rocker shaft and rocker arm. Additionally, the rocker arm construction may allow the bearing to precess, that is, skid so as not to index in the same place on the bearing every cycle. Precessing distributes the wear around the whole bearing rather concentrating it in one place as in a journal.

The advantages of the rocker arm assembly according to the present invention include reducing friction of the rocker arm pivot which results in lower valve train noise and increased fuel economy. Also the present invention provides simple construction and dependable operation, and is simple and less expensive to manufacture both with respect to the tools necessary for manufacturing as well as with respect to the cost of the operation itself. The bearing can be dropped into the rocker arm to ease assembly and no additional housing is required to support the bearing.

While the invention has been described with reference to one preferred embodiment chosen for the purpose of illustration, it should be understood that numerous changes could be made in the rocker arm assembly construction and manufacture without departing from the spirit and the scope of the invention. Accordingly, it is intended that the invention be limited only by the language of the following claims.

We claim:

1. A rocker arm assembly for a rocker shaft comprising:

a rocker arm having an open-topped tub-like body;

said body further comprising a central pivot portion, said pivot portion having a bottom wall and side walls, said bottom wall having a semi-cylindrical extending bottom surface of a diameter greater than the rocker shaft, and said side walls having coaxial bores of a diameter equal to the rocker shaft; and a bearing adapted to fit in the interior of said pivot portion, said bearing having an outer portion radially in contact with said bottom surface and axially constrained by said side walls.

2. The rocker arm assembly of claim 1 wherein said bearing outer portion is the bearing outer race and is in sliding contact with said bottom surface.

3. The rocker arm assembly of claim 2 wherein said bearing comprises a full complement needle bearing.

4. The rocker arm assembly of claim 1 wherein said bearing outer portion is a bearing rolling element and the element is in rolling contact with said bottom surface.

5. The rocker arm assembly of claim 4 wherein said bearing comprises a caged needle bearing.

6. The rocker arm assembly of claim 5 wherein said bearing comprises a cage and roller assembly.

* * * * *